US007367811B2

(12) United States Patent
Nagata

(10) Patent No.: US 7,367,811 B2
(45) Date of Patent: May 6, 2008

(54) COAXIAL CABLE CONNECTOR

(75) Inventor: Takayuki Nagata, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 0 days.

(21) Appl. No.: 11/033,896

(22) Filed: Jan. 13, 2005

(65) Prior Publication Data

US 2005/0159022 A1 Jul. 21, 2005

(30) Foreign Application Priority Data

Jan. 20, 2004 (JP) ..... 2004-011635

(51) Int. Cl.
*H01R 12/00* (2006.01)

(52) U.S. Cl. ..... 439/63

(58) Field of Classification Search ..... 439/578–585, 439/63, 675, 394, 738, 854–855
See application file for complete search history.

(56) References Cited

U.S. PATENT DOCUMENTS 5,759,069 A * 6/1998 Kitatani et al. ..... 439/675
5,772,470 A * 6/1998 Togashi ..... 439/582
6,074,217 A * 6/2000 Maruyama et al. ..... 439/63
6,607,400 B1 * 8/2003 Ko ..... 439/581
6,793,528 B2 * 9/2004 Lin et al. ..... 439/582
6,837,743 B2 * 1/2005 Ko ..... 439/582

OTHER PUBLICATIONS

Japanese patent application laying-open No. 2001-43939.

* cited by examiner

*Primary Examiner*—Edwin A. Leon
(74) *Attorney, Agent, or Firm*—Bacon & Thomas, PLLC

(57) ABSTRACT

The coaxial cable connector of the invention has: a contact to which a central conductor of a coaxial cable is to be connected; an insulation body in which the contact is place; and an outer conductor which has a tubular portion that is placed outside the insulation body with being separated by an annular space from the insulation body, and that has slits, an external conductor of the coaxial cable being to be connected to the outer conductor. A tip end face 4*e* of the insulation body protrudes more than the tip end of the tubular portion having the slits, in the insertion direction. The tip end face of the insulation body as viewed in the insertion direction exists in a minimum fitting range for the case where a cylindrical outer conductor of a receptacle is tried to be fitted into two adjacent slits of the tubular portion.

5 Claims, 4 Drawing Sheets

COAXIAL CABLE CONNECTOR

BACKGROUND OF THE INVENTION

1. Field of the Invention

The present invention relates to a coaxial cable plug which is to be attached to an end of a coaxial cable and fitted to a receptacle serving as a counter connector to be mounted on a circuit board of an electronic device, i.e., a coaxial cable connector.

2. Description of the Prior Art

In order to cope with the trend toward a thin, light, and high-density communication device such as a portable telephone, a low-profile and small coaxial cable connector is used. When such a coaxial cable connector is used, the height of fitting with a receptacle can be suppressed, and the mounting area can be reduced. As an example of such a coaxial cable connector, known is an L-type coaxial cable connector which is to be fitted with a receptacle in a direction perpendicular to the direction along which a coaxial cable is drawn out. The connector comprises: a contact to which the central conductor of the coaxial cable is to be connected; an insulation body which has a substantially cylindrical shape, and in which the contact is placed in a center portion; and an outer conductor which has a tubular portion that has a substantially cylindrical shape, and that is placed outside the insulation body with being separated by an annular space therefrom, and to which the external conductor of the coaxial cable is to be connected, thereby constituting a plug which is to be inserted into a receptacle. When the cylindrical portion (of the outer conductor) of the connector is fitted onto the outside of a cylindrical outer conductor of a receptacle, the cylindrical outer conductor of the receptacle is fitted into the annular space of the connector, and the outer conductors of the connector and the receptacle make contact with each other to establish electrical connection therebetween. At the same time, a stem-like contact of the receptacle is inserted into a center portion of the insulation body of the connector, and the central conductors of the connector and the receptacle make contact with each other to establish electrical connection therebetween.

In the connector, slits are formed in the cylindrical portion of the outer conductor to split the cylindrical portion into plural portions, so that the split portions are formed as spring pieces which are elastically displaceable in a radial direction. A contact which inward protrudes more than the outer diameter of the cylindrical outer conductor of the receptacle is formed on a free end of each of the spring pieces, so that, when the connector is fitted to the receptacle, the contacts are pressed against the outer face of the cylindrical outer conductor of the receptacle by the elasticity of the spring pieces to fittingly hold the connector with respect to the receptacle. In this way, in a connector in which plural spring pieces (the slit cylindrical portion) are arranged on a concentric circle outside a substantially cylindrical insulation body incorporating a contact in a center portion, the tip end face of the insulation body is recessed from the tip ends of the spring pieces (for example, see Japanese Patent Application Laying-Open No. 2001-43939).

SUMMARY OF THE INVENTION

In the case of such a low-profile and small connector, the slit tubular portion of the outer conductor has a diameter which is as small as several millimeters, and hence fitting of the connector to the receptacle is not easily conducted.

Therefore, it is very difficult to accurately fit the connector to the receptacle by one operation while aligning the axis of the slit tubular portion of the connector with that of the cylindrical outer conductor of the receptacle. It is not uncommon that they are fitted to each other in a condition where the axes are not aligned with each other (off-center condition). The outer conductor of the connector is made of a sheet metal having a thickness of about 0.2 mm, and the parts of the tubular portion which are separated by the slits so as to be elastically displaceable in a radial direction, i.e., the spring pieces are particularly susceptible to being deformed.

In the conventional connector, the tip ends of the spring pieces protrude more than the tip end face of the insulation body in the insertion direction. In the case where the connector is to be fitted to the receptacle, when the inserting operation is forcedly conducted in an off-center condition, therefore, the spring pieces interfere with the cylindrical outer conductor of the receptacle to be deformed. When the spring pieces are deformed, there arises a possibility that the fitting force exerted by the connector is reduced and the connector is easily disengaged from the receptacle. Even in the case where the cylindrical outer conductor of the receptacle is fitted into two adjacent slits of the tubular portion of the connector to cause erroneous fitting, the fitting of the connector to the receptacle may be judged to be adequate, thereby producing a risk that a circuit set is assembled while they remain in the erroneous fitting state, and the circuit set cannot exhibit a desired performance.

Therefore, it is a principal object of the invention to provide a coaxial cable connector in which, even in the case where fitting in an off-center condition is tried when the connector is to be fitted to a receptacle serving as a counter connector, a slit cylindrical portion of an outer conductor can be prevented from being deformed, and erroneous fitting can be prevented from occurring.

In order to attain the object, the coaxial cable connector of the invention comprises: a contact to which a central conductor of a coaxial cable is to be connected; an insulation body in which the contact is placed; and an outer conductor having a slit tubular portion which is placed outside the insulation body with being separated by an annular space from the insulation body, an external conductor of the coaxial cable being to be connected to the outer conductor.

The invention is characterized in that a tip end face of the insulation body protrudes more than a tip end of the slit tubular portion in an insertion direction.

According to the configuration, in the case where the connector is tried to be fitted to a receptacle in an off-center condition, the tip end face of the insulation body which protrudes more than the tip end of the slit tubular portion in the insertion direction interferes with a cylindrical outer conductor of the receptacle to block further forced insertion. Therefore, there is no danger of deforming the slit tubular portion.

In the invention, the tip end face of the insulation body as viewed in the insertion direction exists in a minimum fitting range for a case where a cylindrical outer conductor of a receptacle is tried to be fitted into two adjacent slits of the tubular portion. According to the configuration, in the case where the connector is tried to be fitted to a receptacle in an off-center condition, even when the cylindrical outer conductor of the receptacle is tried to be fitted into two adjacent slits of the tubular portion, the tip end face of the insulation body exists in the fitting range, and the tip end face of the insulation body interferes with the cylindrical outer conductor of the receptacle before the cylindrical outer conductor is fitted into the adjacent slits, thereby blocking the connector from being further forcedly inserted into the receptacle. Consequently, there is no danger of erroneously fitting the connector to the receptacle in an off-center condition.

Alternatively, the tip end face of the insulation body as viewed in the insertion direction may exist on a straight line connecting two adjacent slits of the tubular portion. In the alternative, the insulation body is larger in diameter than the above-described insulation body in which the tip end face as viewed in the insertion direction exists in the minimum fitting range for the case where the outer conductor of the receptacle is tried to be fitted into two adjacent slits of the tubular portion. The same effects as described above are exerted.

According to the connector of the invention, when the connector is to be fitted to a receptacle, even in the case where fitting in an off-center condition is tried, the slit cylindrical portion of the outer conductor can be prevented from being deformed, and erroneous fitting can be prevented from occurring. As a result, there is no possibility that the fitting force exerted by the connector is reduced and the connector is easily disengaged from the receptacle, and hence the fitting state (electrical connection state) can be surely held. The invention achieves a further remarkable effect of eliminating the risk that a circuit set is assembled while the connector and the receptacle remain in an erroneous fitting state or in an off-center condition, and the circuit set cannot exhibit a desired performance.

DETAILED DESCRIPTION OF THE PREFERRED EMBODIMENT

Figure 1:
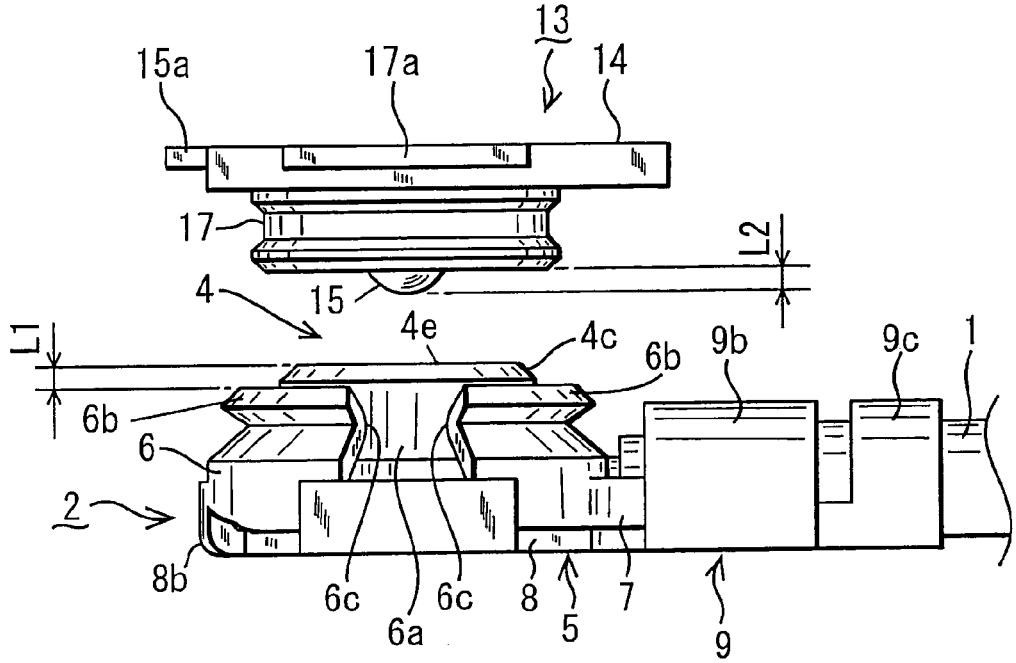
FIG. 1 is a side view of the connector of the invention in a state where the connector is not fitted.
Figure 2:
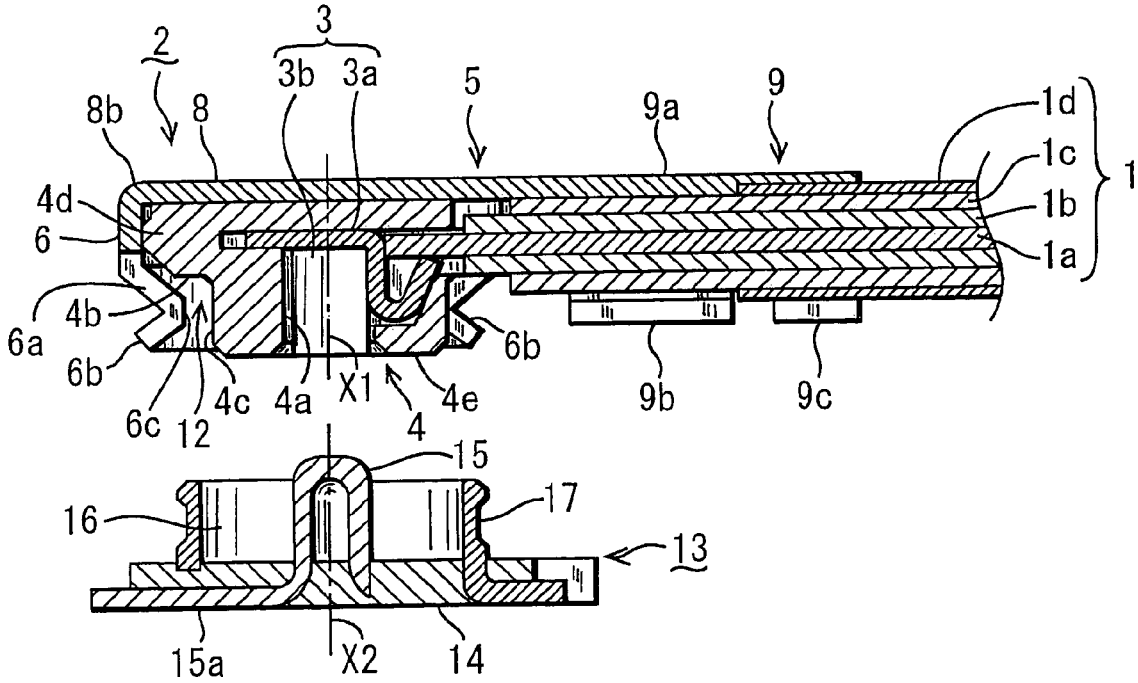
FIG. 2 is a side section view of the connector in the state where the connector is not fitted.
Figure 3:
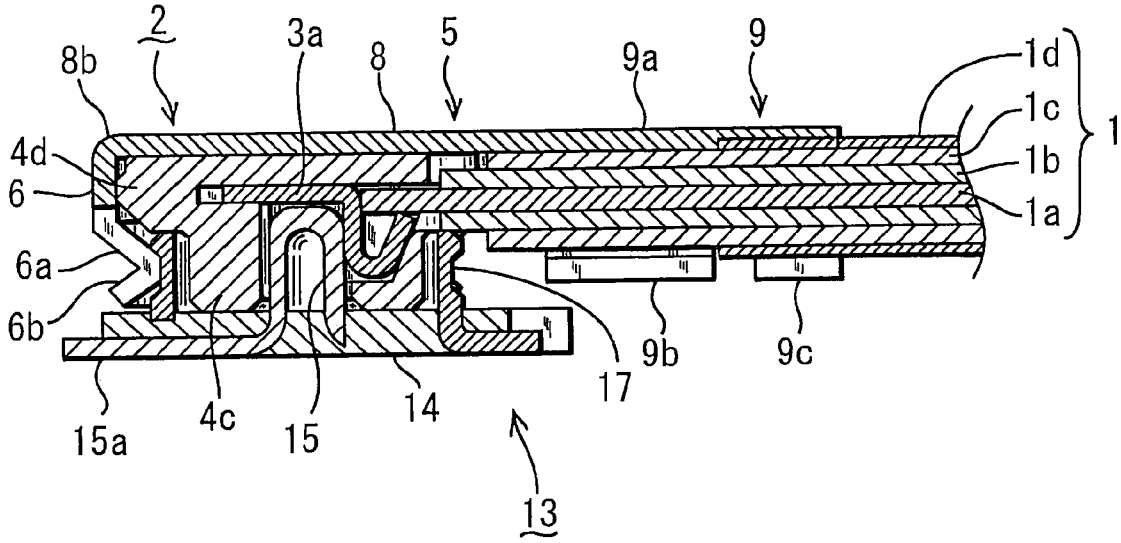
FIG. 3 is a side section view of the connector in a state where the connector is fitted.
Figure 4:
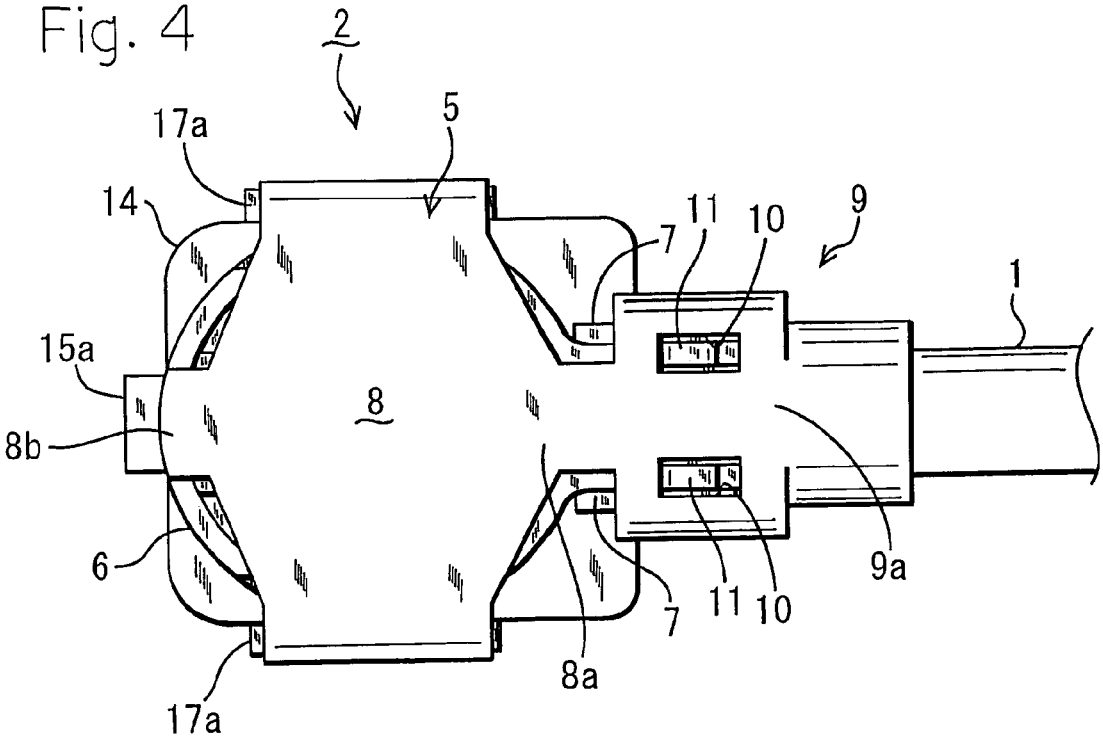
FIG. 4 is a bottom view of the connector.
Figure 5:
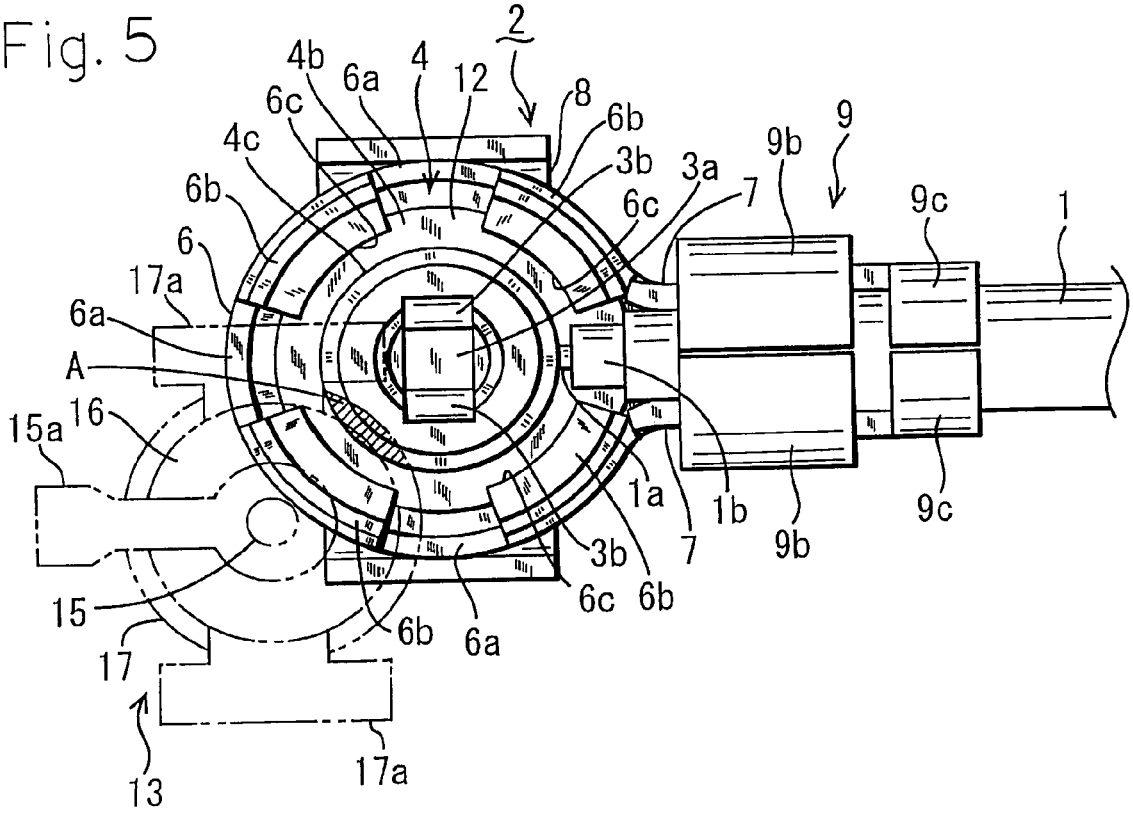
FIG. 5 is a plan view of the connector.
Figure 6:
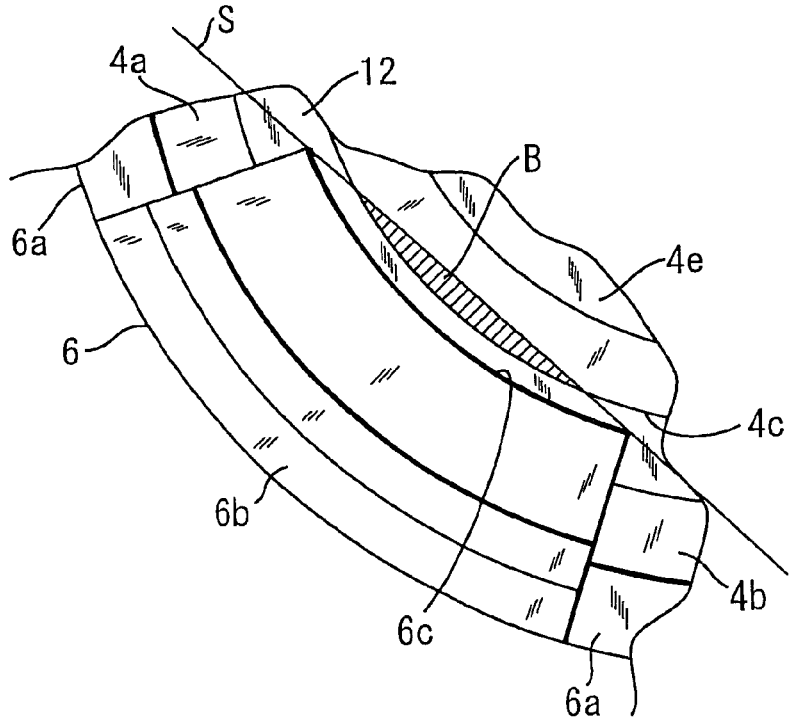
FIG. 6 is a partial enlarged plan view showing a modification of an insulation body of the connector.
Figure 7:
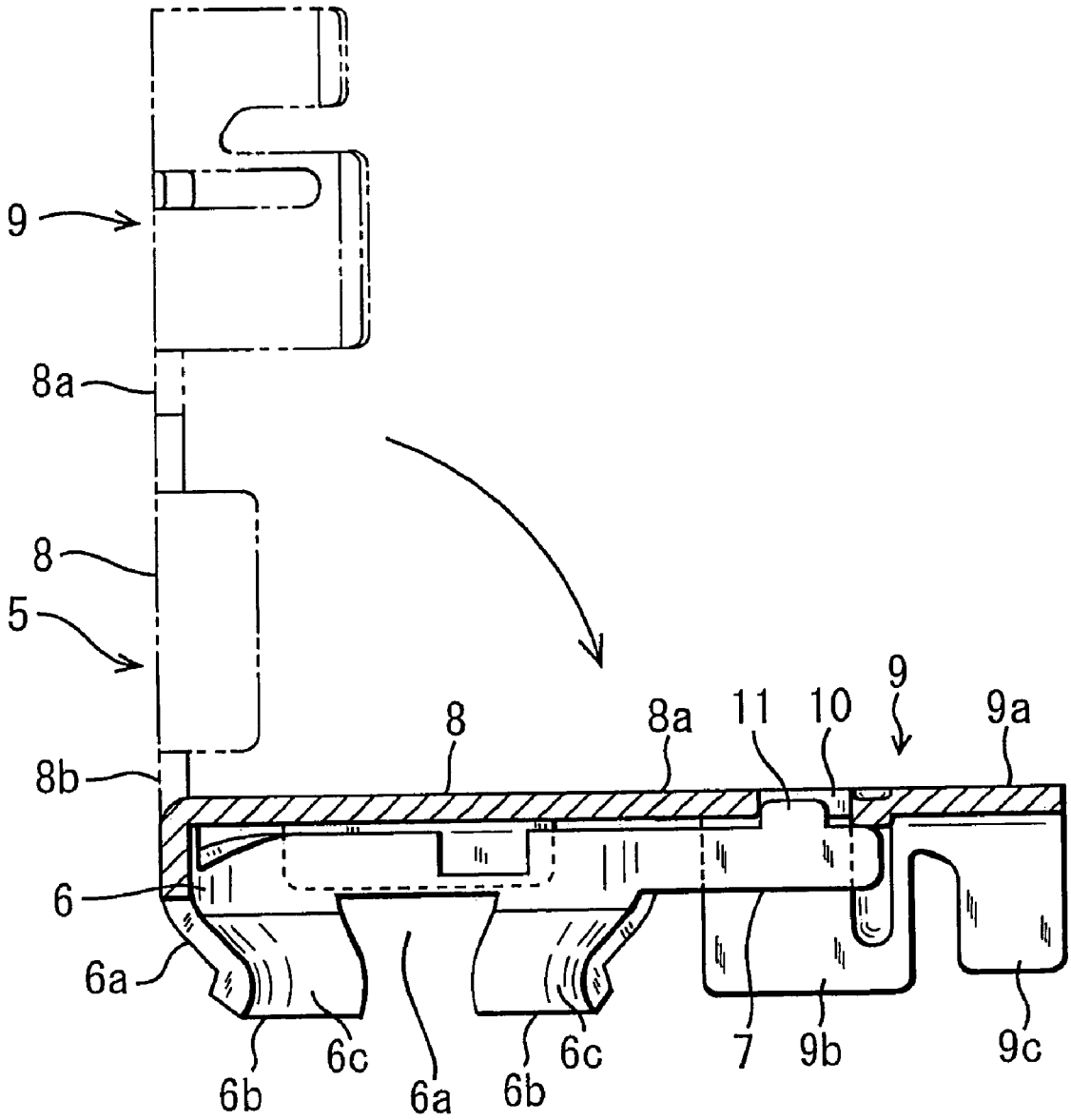
FIG. 7 is a side section view of an outer conductor of the connector.

Hereinafter, an embodiment of the invention will be described with reference to the accompanying drawings. FIG. 1 is a side view of the connector of the invention in a state where the connector is not fitted, FIG. 2 is a side section view of the connector in the state where the connector is not fitted, FIG. 3 is a side section view of the connector in a state where the connector is fitted, FIG. 4 is a bottom view of the connector, FIG. 5 is a plan view of the connector, FIG. 6 is a partial enlarged plan view showing a modification of an insulation body of the connector, and FIG. 7 is a side section view of an outer conductor of the connector.

Referring to the figures, 1 denotes a coaxial cable having a central conductor 1*a*. An inner insulation cover layer 1*b* is formed around the outer periphery of the conductor, and a hollow cylindrical conductor or an external conductor 1*c* is formed around the outer periphery of the inner insulation cover layer 1*b*. The outer periphery of the external conductor is covered by a cable jacket 1*d* serving as an outer insulation cover layer in the surface of the cable. A peeling process is applied on an end of the coaxial cable 1 to which a connector 2 that will be described later is to be attached, so that the central conductor 1*a* and the external conductor 1*c* are exposed by respective predetermined lengths.

The connector 2 comprises: a contact 3 which is to be solder-connected to the central conductor 1*a* of the coaxial cable 1, and which is made of a metal such as a copper alloy; a substantially cylindrical resin-made insulation body 4 in which the contact 3 is placed in a center portion so as to be surrounded, in which the coaxial cable 1 is radially drawn out from the outer peripheral face, and which is stepped; and an outer conductor 5 which is made of a sheet metal of a copper alloy and having a thickness of about 0.2 mm.

The contact 3 has: a connecting portion 3*a* in which the central conductor 1*a* of the coaxial cable 1 is to be solder-connected to the tip end; and a pair of contacting portions 3*b*, 3*b* which are opposingly raised from side edges of the other end of the connecting portion 3*a*, respectively, and between which a stem-like central contact 15 of a receptacle 13 that will be described later is to be inserted to make contact therewith.

The insulation body 4 has a substantially L-like hollow portion 4*a* which houses the contact 3. The hollow portion 4*a* is formed in a center portion of the insulation body 4 so as to vertically extend along the axis of the body. An end of the hollow portion 4*a* is opened in a center area of the tip end face 4*e* of a small-diameter portion 4*c* which is on the tip end side with respect to a step portion 4*b* of the insulation body 4. The stem-like central contact 15 of the receptacle 13 is inserted into the vertical hollow portion 4*a* with starting from the center area of the tip end face 4*e* of the small-diameter portion 4*c*, thereby causing the contact to make contact with the pair of contacting portions 3*b*, 3*b* of the contact 3 which are placed on the both sides of the vertical hollow portion 4*a*, respectively. Another end of the lateral hollow portion 4*a* which is formed so as to radially extend from a center area of the insulation body 4 is opened in the outer peripheral face of a large-diameter portion 4*d* which is on the basal end side of the insulation body 4 with respect to the step portion 4*b*. The central conductor 1*a* of the coaxial cable 1 is solder-connected to the tip end portion of the connecting portion 3*a* of the contact 3 which is placed in the lateral hollow portion 4*a*, thereby enabling the coaxial cable 1 to be radially drawn out from the outer peripheral face of the insulation body 4.

The outer conductor 5 is formed by stamping out a thin metal member into a predetermined shape, and bending the stamped-out sheet, and has: a substantially cylindrical tubular portion 6; a pair of right and left cable guides 7, 7; a lid portion 8; and a crimp flange portion 9. The tubular portion 6 and the cable guides 7, 7 are formed in the following manner. A strip-like sheet is curved in a substantially semicircular shape so that basal portions of one and other sides with respect to a center portion are opposed to each other. The remaining end portions are linearly elongated in one direction (radial direction) from the end portions of the curved portion so as to be opposed to each other across a predetermined gap. A cylindrical wall of the tubular portion 6 which is partly interrupted is formed by the opposing substantially semicircular curved portions. The pair of right and left cable guides 7, 7 are formed by opposing linear portions (parallel portions). The insulation body 4 is concentrically housed in the tubular portion 6. The coaxial cable 1 which is radially drawn out from the outer peripheral face of the insulation body 4 is radially drawn out through the interrupted portion of the cylindrical wall and between the right and left cable guides 7, 7. The right and left cable guides 7, 7 laterally clamp the portion of the coaxial cable 1 in which the cable jacket 1*d* is peeled off, so as to make contact with the external conductor 1*c*.

The lid portion 8 is formed into a flat planer shape which covers the bottom opening of the tubular portion 6 which is opposite to the receptacle insertion port, and, in one side, has a narrow connecting portion 8*a* connected to the crimp flange portion 9. The crimp flange portion 9 has: a flat portion 9*a* which is continuous to the lid portion 8 via the connecting portion 8*a*; a pair of right and left basal crimping pieces 9*b*, 9*b* which are inclinedly raised from both the side edges of the basal end side of the flat portion 9*a* so that the relative distance between the pieces is gradually increased as advancing toward the tip end; and a pair of right and left end crimping pieces 9*c*, 9*c* which are inclinedly raised from both the side edges of the tip end side of the flat portion 9*a* so that the relative distance between the pieces is gradually increased as advancing toward the tip end. The crimp flange portion 9 is formed so as to be continuous with one side of the lid portion 8. In the other side of the lid portion 8 which is opposite to the crimp flange portion 9, the lid portion 8 has a to-be-bent portion 8*b* which is connected to the tubular portion 6, and which is to be bent later. The series of the lid portion 8 and the crimp flange portion 9 are bendably connected via the to-be-bent portion 8*b* to the bottom edge of the cylindrical wall of the tubular portion 6 which is opposite to the interrupted portion of the cylindrical wall (opposite to the cable drawn-out direction). The series of the lid portion 8 and the crimp flange portion 9 are bent from a semi-folded posture which is formed before assembling, and in which, as shown by the phantom lines in FIG. 7, the to-be-bent portion 8*b* is stretched and the lid portion 8 and the crimp flange portion 9 are perpendicular to the bottom faces of the tubular portion 6 and the right and left cable guides 7, 7, to an assembling posture in which, as shown by the solid lines in FIG. 7, the to-be-bent portion 8*b* is bent and the lid portion 8 and the crimp flange portion 9 are parallel to the bottom faces of the tubular portion 6 and the right and left cable guides 7, 7. As a result of this bending, the lid portion 8 can close the bottom opening of the tubular portion 6, and the flat portion 9*a* of the basal portion of the crimp flange portion 9 and the basal crimping pieces 9*b*, 9*b* surround the right and left cable guides 7, 7 between which the coaxial cable 1 is to be passed, and which are to make contact with the external conductor 1*c*. When a crimping process is applied, the cable guides can be crimped to the coaxial cable 1. Furthermore, the flat portion 9*a* of the end portion and the right and left end crimping pieces 9*c*, 9*c* surround the unpeeled portion of the coaxial cable 1 which is drawn out between the right and left cable guides 7, 7. When a crimping process is applied, the coaxial cable 1 can be clamped.

As described above, in the outer conductor 5, the tubular portion 6 is disposed in the basal portion of the outer conductor 5 which is on one side with respect to the to-be-bent portion 8*b*, the pair of right and left cable guides 7, 7 are disposed in the end portion of the outer conductor 5, the lid portion 8 is disposed in the basal portion of the outer conductor 5 which is on the other side with respect to the to-be-bent portion 8*b*, and the crimp flange portion 9 is disposed in the end portion of the outer conductor 5. In the outer conductor 5 which is on one side with respect the to-be-bent portion 8*b* on the side where the crimp flange portion 9 is disposed, disposed are through holes (confirmation windows) 10, 10 through which the status of the outer conductor 5 on the other side with respect the to-be-bent portion 8*b* on the side where the tubular portion 6 is disposed can be checked. Protrusions 11, 11 are disposed on the outer conductor 5 on one side with respect the to-be-bent portion 8*b* on the side where the tubular portion 6 is disposed. The through holes 10, 10 are formed in positions to which the protrusions 11, 11 are fitted when the outer conductor 5 is bent in the to-be-bent portion 8*b* to the crimping state. Specifically, the protrusions 11, 11 are protruded from the bottom faces of the tip ends of the right and left cable guides 7, 7 which are to be joined to the flat portion 9*a* of the crimp flange portion 9, respectively, and their protrusion lengths are set to be substantially equal to the thickness (the depths of the through holes 10, 10) of the flat portion 9*a* of the crimp flange portion 9. In accordance with this configuration, the two through holes 10, 10 are laterally juxtaposed in the basal area of the flat portion 9*a* of the crimp flange portion 9.

In the tubular portion 6 of the outer conductor 5, a plurality of slits 6*a* which extend from the end on the side of the receptacle insertion port by a predetermined depth are formed in order to split the cylindrical wall to plural portions. The split portions of the cylindrical wall which are separated by the slits 6*a* are formed as spring pieces 6*b* which are elastically displaceable in a radial direction. A contact 6*c* which inward protrudes more than the outer diameter of a cylindrical outer conductor 17 of the receptacle 13 is formed on a free end of each of the spring pieces 6*b* so that the spring pieces 6*b* are arranged on a concentric circle outside the small-diameter portion 4*c* of the insulation body 4.

The insulation body 4 is configured in the following manner. The outer diameter of the large-diameter portion 4*d* which is on the basal end side with respect to the step portion 4*b* is larger than that of the cylindrical outer conductor 17 of the receptacle 13, and substantially equal to the inner diameter of the bottom side of the tubular portion 6 in which the portion is not split. The outer diameter of the small-diameter portion 4*c* which is on the tip end side with respect to the step portion 4*b* is smaller by a predetermined dimension than the inner diameter of the split portions of the tubular portion 6 which are to be placed outside the small-diameter portion, i.e., that of the contacts 6*c* of the spring pieces 6*b*, and smaller than the inner diameter of the cylindrical outer conductor 17 of the receptacle 13. The insulation body 4 is housed and supported at a concentric position in the tubular portion 6 by means of the outer diameter of the large-diameter portion 4*d*. An annular space 12 into which the cylindrical outer conductor 17 of the receptacle 13 is to be fitted is formed between the small-diameter portion 4*c* of the insulation body 4 and the spring pieces 6*b* which are arranged on a concentric circle outside the small-diameter portion 4*c*.

The height of the insulation body 4 is set so that, when the insulation body 4 is housed in the tubular portion 6 in a state where the bottom face makes contact with the lid portion 8, the tip end face 4*e* of the small-diameter portion 4*c* of the insulation body 4 into which the stem-like central contact 15 of the receptacle 13 is inserted protrudes by a predetermined dimension (L1) more than the tip ends (free ends) of the spring pieces 6*b* in the insertion direction. In summary, the height of the insulation body 4 is lager by the predetermined dimension (L1) than that of the cylindrical wall of the tubular portion 6 of the outer conductor 5.

Next, assembling of the connector 2 will be described. First, the outer conductor 5 in the semi-folded state is placed with a posture in which the receptacle insertion port of the tubular portion 6 is downward directed. The insulation body 4 is inserted into the tubular portion 6 from the bottom side. The contact 3 to which the central conductor 1*a* of the coaxial cable 1 is solder-connected is housed in the hollow portion 4*a* of the insulation body 4. The coaxial cable 1 which is radially drawn out from the outer peripheral face of the insulation body 4 is drawn out through the interrupted portion of the cylindrical wall of the tubular portion 6 and between the right and left cable guides 7, 7 in an outer radial direction of the tubular portion 6. The portion of the coaxial cable 1 in which the jacket 1*d* of the coaxial cable 1 is peeled off is clamped by the right and left cable guides 7, 7 from the laterally outside, so that the external conductor 1*c* makes contact with the cable guides 7, 7. Next, the series of the lid portion 8 and the crimp flange portion 9 are bent in the to-be-bent portion 8*b* from the vertical posture indicated by the phantom lines in FIG. 7 to the horizontal posture indicated by the solid lines, so that the bottom opening of the tubular portion 6 is covered by the lid portion 8, the right and left cable guides 7, 7 between which the coaxial cable 1 is passed, and which make contact with the external conductor 1*c* are surrounded by the flat portion 9*a* of the basal portion of the crimp flange portion 9 and the basal crimping pieces 9*b*, 9*b*, and the unpeeled portion of the coaxial cable 1 which is drawn out between the right and left cable guides 7, 7 is surrounded by the flat portion 9*a* of the end portion of the crimp flange portion 9 and the right and left end crimping pieces 9*c*, 9*c*. At this time, the right and left protrusions 11, 11 which are formed on the tip end portions of the right and left cable guides 7, 7 are fitted into the two through holes 10, 10 which are laterally juxtaposed in the basal area of the flat portion 9*a* of the crimp flange portion 9, respectively.

In the conventional art, as a result of bending of the outer conductor 5, the outer conductor 5 which is on the side where the lid portion 8 and the crimp flange portion 9 are disposed, and which is on the side of one end with respect to the to-be-bent portion 8*b* is laid over the outer conductor 5 which is on the side where the tubular portion 6 housing the insulation body 4 and the right and left cable guides 7, 7 are disposed, and which is on the side of one end with respect to the to-be-bent portion 8*b*, and the lower outer conductor 5 is covered by the upper outer conductor 5, so that the status of the lower outer conductor 5, i.e., the status of the tubular portion 6 (whether the tubular portion 6 is settled at the predetermined position or not, and whether an abnormality such as rising, eccentricity, or deformation occurs or not) cannot be confirmed. By contrast, in the embodiment, the status can be confirmed accurately and easily by means of the through holes 10, 10, and also by fitting between the through holes 10, 10 and the protrusions 11, 11. This confirmation can be conducted by observing the fitting states of the protrusions 11, 11 such as fitting positions and fitting depths of the protrusions 11, 11 with respect to the right and left through holes 10, 10, or comparing the fitting states of the right and left protrusions 11, 11 and observing the difference between the states.

In the case where, as a result of the above confirmation, it is confirmed that the tubular portion 6 is not settled at the predetermined position, and an abnormality such as rising, eccentricity, or deformation occurs, there is a possibility that the connector is a defective product which cannot be correctly fitted to the receptacle 13. Therefore, an adequate process may be applied on the connector to eliminate the abnormality, or the connector may be removed away. On a normal connector in which no abnormality is observed, a crimping process of crimping the basal and end portions of the crimp flange portion 9 to the coaxial cable 1 to cause plastic deformation is conducted to assemble the connector 2 into the assembled state shown in FIGS. 1 to 5.

In the crimping process, the fitting between the through holes 10, 10 and the protrusions 11, 11 exerts a function of positioning the outer conductor 5 which is on the side where the tubular portion 6 and the right and left cable guides 7, 7 are disposed, and which is on the side of one end with respect to the to-be-bent portion 8*b*, with respect to the outer conductor 5 which is on the side where the lid portion 8 and the crimp flange portion 9 are disposed, and which is on the side of one end with respect to the to-be-bent portion 8*b*, whereby the tubular portion 6 is prevented from, during the crimping process, being positionally deviated in the cable drawn-out direction, or a direction opposite or perpendicular to the cable drawn-out direction, or causing eccentricity or deformation.

Therefore, the assembled connector 2 of the embodiment comprises: the contact 3 to which the central conductor la of the coaxial cable 1 is to be connected; the insulation body 4 in which the contact 3 is placed; and the outer conductor 5 which is made of a sheet metal, and to which the external conductor 1*c* of the coaxial cable 1 is to be connected. The outer conductor 5 comprises: the tubular portion 6 which houses the insulation body 4; the lid portion 8 which is extended from the tubular portion 6, and which is bent onto the bottom face of the tubular portion 6; the crimp flange portion 9 which is extended in the cable drawn-out direction from the tubular portion 6 via the lid portion 8, and which is to be crimped to the coaxial cable 1; and the pair of right and left cable guides 7, 7 which are extended directly from the tubular portion 6 in the cable drawn-out direction, and which are to be crimped by the inner side of the crimp flange portion 9 in the state where the cable guides make contact with the external conductor 1*c* of the coaxial cable 1. The tubular portion 6 in which the contact 3 is attached to the center (concentric) position via the insulation body 4, and which is to be fitted to the receptacle 13 is crimped and fixed to the end of the coaxial cable 1.

Moreover, the through holes (confirmation windows) 10, 10 for checking the status of the outer conductor 5 on the other side with respect the to-be-bent portion 8*b* on the side where the tubular portion 6 is disposed are formed in the outer conductor 5 which is on the one side with respect the to-be-bent portion 8*b* where the crimp flange portion 9 is disposed. When the clamping (crimping) step is to be conducted, the status of the outer conductor 5 on the one side with respect the to-be-bent portion 8*b* on the side where the tubular portion 6 is disposed, i.e., that of the tubular portion 6 is checked via the through holes 10, 10, and the step is conducted after confirming that there is no abnormality, whereby occurrence of a defective product due to a bending failure of the outer conductor 5 or the like can be substantially eliminated. Since the connector comprises the plurality of through holes 10, 10, the status of the tubular portion 6 is correctly confirmed and its accuracy is enhanced. In the connector, the configuration is employed which comprises the protrusions 11, 11 on the outer conductor 5 on the one side with respect the to-be-bent portion 8*b* on the side where the tubular portion 6 is disposed, and, when the outer conductor 5 is bent to the crimping state, the protrusions 11, 11 are fitted into the through holes 10, 10. Therefore, the protrusions 11, 11 function as an indicator, so that, when the fitting states of the protrusions 11, 11 such as fitting positions and fitting depths of the protrusions 11, 11 with respect to the right and left through holes 10, 10 are observed, the status of the tubular portion 6 can be confirmed more correctly, accurately, and easily. Moreover, in the state where the protrusions 11, 11 are fitted into the through holes 10, 10, i.e., the state where the outer conductor 5 on the one side with respect the to-be-bent portion 8*b* of the outer connector 5 on the side where the tubular portion 6 is disposed is positioned with respect to the outer conductor 5 which is on the other side with respect the to-be-bent portion 8*b* on the side where the crimp flange portion 9 is disposed, the crimp flange portion 9 is crimped to the coaxial cable 1, whereby, during the crimping process, the tubular portion 6 is prevented from being positionally deviated in the cable drawn-out direction, or a direction opposite or perpendicular to the cable drawn-out direction, or causing eccentricity or deformation. Since the configuration in which the through holes 10, 10 are provided in the crimp flange portion 9 and the protrusions 11 are provided on the cable guides 7, 7 is employed, the status of the tubular portion 6 can be confirmed at a position which is separated (remote) from the to-be-bent portion 8*b* of the outer conductor 5, and in which the status of the tubular portion 6 notably appears, and the confirmation can be conducted more correctly, accurately, and easily. Moreover, the protrusions 11, 11 are fitted into the through holes 10, 10 at a position which is separated from the to-be-bent portion 8*b*, and the fitting causes the cable guides 7, 7 which are engaged with the crimp flange portion 9 to be crimped by the inner side of the crimp flange portion 9, whereby the tubular portion 6 is effectively prevented from being positionally deviated, or causing eccentricity or deformation. Furthermore, the configuration is employed in which the protrusions 11, 11 are provided respectively on the tip end sides of the pair of right and left cable guides 7, 7, and the two through holes 10, 10 are laterally juxtaposed in the crimp flange portion 9 so as to correspond to the protrusions 11, 11, so that all the effects due to the above-described configuration are achieved. The fitting states of the right and left protrusions 11, 11 are compared with each other, and the difference between them is observed, whereby the status of the tubular portion 6 can be confirmed more correctly, accurately, and easily.

As described above, the tubular portion 6 of the outer conductor 5 in which positional displacement, eccentricity, and deformation occurring during an assembling process can be suppressed is fitted to the receptacle 13. The tubular portion 6 houses at a concentric position the stepped insulation body 4 in which the contact 3 is placed in a center portion, and which has a substantially cylindrical shape, and is placed with forming the annular space 12 outside the insulation body 4. The slits 6*a* are formed in the tubular portion 6, and the split cylindrical walls which are separated by the slits 6*a* to be elastically displaceable in a radial direction, i.e., the spring pieces 6*b* are concentrically arranged outside the insulation body 4 with being separated therefrom by the annular space 12. The tip end face of the insulation body 4 protrudes more than the tip ends of the spring pieces 6*b* by the predetermined dimension (L1) in the direction of insertion into the receptacle 13.

The receptacle 13 which is a counter connector for the connector 2 comprises: a resin-made insulation body 14 which has a rectangular plate-like shape; the stem-like central contact 15 which is raised from a substantially center portion of the insulation body 14; and the cylindrical outer conductor 17 which is raised from the insulation body 14 coaxially with the contact 15 with being separated therefrom by an annular space 16. A contact portion 15*a* in which the surface is exposed from the rear face of the insulation body 14 so as to be flush therewith, and the tip end protrudes from a center portion of one side edge of the insulation body 14 is disposed in the basal end of the contact 15. A pair of contact portions 17*a*, 17*a* are disposed in the basal end of the outer conductor 17. In the contact portions 17*a*, 17*a*, the surfaces are exposed from the rear face of the insulation body 14 so as to be flush therewith, and the tip ends protrude from center portions of the side edges which are adjacent to one side edge of the insulation body 14 from which the contact portion 15*a* of the contact 15 protrudes. The contact portions 15*a*, 17*a*, 17*a* are solder-connected to a circuit board (not shown) of a communication device such as a portable telephone. As a result, the receptacle is mounted in a state where the receptacle is electrically connected to the circuit board, and an insertion port for the above-described connector (plug) 2 is formed on the circuit board.

As shown in FIGS. 1 and 2, in the state where the insertion ports of the connector 2 and the receptacle 13 are opposed to each other while aligning the axis X1 of the tubular portion 6 of the connector 2 with the axis X2 of the cylindrical outer conductor 17 of the receptacle 13, the tubular portion 6 of the connector 2 is fitted onto the cylindrical outer conductor 17 of the receptacle 13, whereby, as shown in FIG. 3, the cylindrical outer conductor 17 of the receptacle 13 is fitted into the annular space 12 of the connector 2, and the outer conductors 5 and 17 of the connector 2 and the receptacle 13 make contact with each other to establish electrical connection therebetween. At the same time, the small-diameter portion 4*c* of the insulation body 4 of the connector 2 is fitted into the annular space 16 of the receptacle 13, and the stem-like contact 15 of the receptacle 13 is inserted into a center portion of the insulation body 4 with starting from the tip end face 4*e* of the small-diameter portion 4*c*, and the central conductors 3 and 15 of the connector 2 and the receptacle 13 make contact with each other to establish electrical connection therebetween. After the fitting, the contacts 6*c* of the free ends of the spring pieces 6*b* are pressed against the outer face of the cylindrical outer conductor 17 of the receptacle 13 by the elasticity of the spring pieces 6*b* so that the fitting can be held.

In the case where the connector 2 is fitted to the receptacle 13 in an off-center condition where the axis X1 of the tubular portion 6 of the connector 2 is slightly deviated from the axis X2 of the cylindrical outer conductor 17 of the receptacle 13, the tip end face 4*e* of the insulation body 4 of the connector 2 interferes with the cylindrical outer conductor 17 of the receptacle 13 because the tip end face 4*e* of the insulation body 4 protrudes by the predetermined dimension (L1) in the direction of insertion to the receptacle 13 from the tip ends (the tip end of the slit tubular portion 6) of the spring pieces 6*b* of the connector 2. Consequently, the connector 2 cannot be further forcedly inserted to the receptacle 13. Even in the case where an operation of fitting the connector 2 to the receptacle 13 is conducted in such an off-center condition, therefore, the spring pieces 6*b* which are recessed from the tip end face 4*e* of the insulation body 4 of the connector 2 does not interfere with the cylindrical outer conductor 17 of the receptacle 13, and the spring pieces 6*b* are not deformed, whereby a situation where the connector 2 is unexpectedly caused to be disengaged from the receptacle 13 by reduction of the fitting force between the connector 2 and the receptacle 13 due to such deformation is prevented from occurring.

When the deviation between the axis X1 of the tubular portion 6 of the connector 2 and the axis X2 of the cylindrical outer conductor 17 of the receptacle 13 is further increased, the cylindrical outer conductor 17 of the receptacle 13 is fitted into two adjacent slits 6*a*, 6*a* of the tubular portion 6 as shown in FIG. 5. As a result, there may arise a situation where they are mounted while it is erroneously judged that the connector 2 is adequately fitted to the receptacle 13, a circuit set is assembled, and the circuit set cannot exhibit a desired performance. In the embodiment, in order to prevent such a situation from arising, the outer diameter of the small-diameter portion 4*c* of the insulation body 4 of the connector 2 is set in the following manner.

Namely, the outer diameter of the small-diameter portion 4*c* of the insulation body 4 of the connector 2 is set so that the tip end face 4*e* of the insulation body 4 as viewed in the insertion direction exists in the minimum fitting range for the case where, as shown in FIG. 5, the cylindrical outer conductor 17 of the receptacle 13 is tried to be fitted into the two adjacent slits 6*a*, 6*a* of the tubular portion 6 of the connector 2, or more specifically in the fitting range for the case where, the center-to-center distance between the tubular portion 6 of the connector 2 and the cylindrical outer conductor 17 of the receptacle 13 is longest, and the cylindrical outer conductor 17 of the receptacle 13 is fitted into the two adjacent slits 6*a*, 6*a* of the tubular portion 6 of the connector 2. The hatched portion A in FIG. 5 shows the tip end face 4*e* of the insulation body 4 which exists in the minimum fitting range.

Alternatively, as shown in FIG. 6, the outer diameter of the small-diameter portion 4*c* of the insulation body 4 of the connector 2 may be set so that the tip end face 4*e* of the insulation body 4 as viewed in the insertion direction exists on a straight line S connecting the two adjacent slits 6*a*, 6*a* of the tubular portion 6 of the connector 2. Specifically, the outer diameter of the small-diameter portion 4*c* of the insulation body 4 of the connector 2 may be set so that the tip end face 4*e* of the insulation body 4 as viewed in the insertion direction exists in a bow-shaped space in which the smallest-diameter inner face of one spring piece 6*b* is formed as the arch, and a straight line connecting the ends of the arch, i.e., the straight line S connecting the two adjacent slits 6*a*, 6*a* is formed as the string. The hatched portion B in FIG. 6 shows the tip end face 4*e* of the insulation body 4 which exists in the bow-shaped space inside the one spring piece 6*b*.

As a result of the above-described configuration, in the case where the connector 2 is tried to be fitted to the receptacle 13 in an off-center condition, even when the cylindrical outer conductor 17 of the receptacle 13 is tried to be fitted into the two adjacent slits 6*a*, 6*a* of the tubular portion 6 of the connector 2, the tip end face 4*e* of the insulation body 4 exists in the fitting range, and therefore the tip end face 4*e* of the insulation body 4 interferes with the cylindrical outer conductor 17 of the receptacle 13 before the fitting is completed, so that the connector 2 cannot be further forcedly inserted to the receptacle 13. Consequently, erroneous fitting in which the cylindrical outer conductor 17 of the receptacle 13 is fitted into two adjacent slits 6*a* of the tubular portion 6 of the connector 2 can be prevented from occurring. It is a matter of course that, in any event, the outer diameter of the small-diameter portion 4*c* of the insulation body 4 is set to a value at which the small-diameter portion can be fitted inside the cylindrical outer conductor 17 of the receptacle 13.

As described above, the connector comprises: the contact 3 to which the central conductor 1*a* of the coaxial cable 1 is to be connected; the insulation body 4 in which the contact 3 is placed; and the outer conductor 5 which has the tubular portion 6 that is placed outside the insulation body 4 with being separated by the annular space 12 therefrom, and that has the slits 6*a*, and to which the external conductor 1*c* of the coaxial cable 1 is to be connected. In accordance with the coaxial cable connector 2 in which the tip end face 4*e* of the insulation body 4 protrude more than the tip end of the tubular portion 6 having the slits 6*a*, in the insertion direction, also the receptacle 13 serving as a counter connector is configured so that the tip end of the central contact 15 protrudes more than the tip end of the cylindrical outer conductor 17 by the predetermined distance L2 in the direction of insertion into the connector 2. According to the configuration, when the connector 2 is to be fitted to the receptacle 13, the insertion length of the stem-like central contact 15 of the receptacle 13 which is to be inserted between the pair of contacting portions 3*b*, 3*b* of the contact 3 of the connector 2 is sufficiently ensured, so that a connection failure and the like are prevented from occurring.

What is claimed is:

1. A coaxial cable connector, comprising:

a central conductor;

an external conductor;

a contact to which said central conductor is connected;

an insulation body in which said contact is placed; and an outer conductor which has a tubular portion that is placed outside said insulation body and separated by an annular space from said insulation body, wherein:

said tubular portion having slits and defining an annular space with said insulation body;

said annular space serving to receive a cylindrical outer conductor of a receptacle;

said external conductor being connected to said outer conductor;

a tip end face of said insulation body protrudes more than a tip end of said tubular portion having said slits, when viewed in an insertion direction and said tip end face of said insulation body when viewed in the insertion direction is located in a minimum fitting range when said cylindrical outer conductor of said receptacle is fitted into two adjacent slits of said tubular portion.

2. The coaxial cable connector according to claim 1, wherein:

said tip end face of said insulation body when viewed in the insertion direction is located on a straight line connecting two adjacent slits of said tubular portion.

3. The coaxial cable connector according to claim 1, wherein:

said tubular portion defines an axis and the outer conductor of the receptacle defines an axis; and said axes coincide due to said slits when said annular space receives the cylindrical outer conductor of the receptacle.

4. The coaxial cable connector according to claim 1, wherein:

the cylindrical outer conductor of the receptacle is received and removed from said annular space due to said slits.

5. The coaxial cable connector according to claim 1, further comprising:

a contact which extends along said cylindrical outer conductor, which engages said contact to which said central conductor is connected when said cylindrical outer conductor is received in said annular space.

* * * * *